US006398230B1

(12) United States Patent
Rudolph

(10) Patent No.: US 6,398,230 B1
(45) Date of Patent: Jun. 4, 2002

(54) ROLLER SKATE WITH ANGLED WHEELS

(75) Inventor: Robert Rudolph, Morton Grove, IL (US)

(73) Assignee: V-Formation, Inc., Lincoln Park, NJ (US)

( * ) Notice: Subject to any disclaimer, the term of this patent is extended or adjusted under 35 U.S.C. 154(b) by 0 days.

(21) Appl. No.: 09/727,568

(22) Filed: Nov. 30, 2000

(51) Int. Cl.[7] ..... A63C 17/06

(52) U.S. Cl. ..... 280/11.223; 280/11.221; 280/11.231

(58) Field of Search ..... 280/11.223, 841, 280/11.19, 11.221, 11.231, 11.232, 11.233, 11.3, 11.17

(56) References Cited

U.S. PATENT DOCUMENTS 5,303,940 A * 4/1994 Brandner ..... 280/11.22
5,566,957 A * 10/1996 Ho ..... 280/11.22
5,732,957 A * 3/1998 Yu ..... 280/11.19
5,816,588 A * 10/1998 Nicoletti ..... 280/11.22
5,855,380 A * 1/1999 Di Filippo et al. ..... 280/7.13
6,003,882 A * 12/1999 Colonese, Jr. et al. ... 280/11.22
6,142,489 A * 11/2000 Borel ..... 280/11.22
6,173,975 B1 * 1/2001 Brandner ..... 280/11.22
6,227,550 B1 * 5/2001 Maggiolo ..... 280/11.223
6,301,771 B1 * 10/2001 Benoit ..... 29/557

* cited by examiner

*Primary Examiner*—J. J. Swann
*Assistant Examiner*—J. Allen Shriver
(74) *Attorney, Agent, or Firm*—Mark G. Pannell; Hanes & Schutz, P.C.

(57) ABSTRACT

A roller skate has a base, a plurality of tandem frames, a like plurality of axles, and a like plurality of wheels. Each frame is affixed to the base and has bilateral, spaced apart, opposing side walls that define a wheel well. Adjacent side walls of the frames are interconnected to form unitary opposing structures. The side walls of one of the frames is angularly related to the side walls of at least one of the other frames. Each axle is carried in a wheel well by the side walls of one of the frames. Each wheel is disposed within one of the wheel wells and mounted for rotation on the axle in the wheel well. The wheel wells are either equally or unequally spaced. The roller skate may further include an article of footwear, such as a shoe or a boot, to which the base is either affixed or integral. Additionally, at least one brace may interconnect the opposing walls of at least one frame.

19 Claims, 3 Drawing Sheets

ROLLER SKATE WITH ANGLED WHEELS

FIELD OF THE INVENTION

This invention relates in general to roller skates and, more particularly, to roller skates having wheels disposed at an angle.

BACKGROUND OF THE INVENTION

Inline roller skates have long been known. The wheels of the inline skates are arranged in tandem and disposed in a common plane. The tandem wheels disposed in a common plane cause the skate to travel in a straight line. In order to turn the skate, the skater must lean the skate, causing the wheels to lose some traction with the skating surface and slide. The more the wheels lean, the less traction they have on the skating surface. The reduced traction causes the wheels to slip. As the wheels slip, the skate turns.

Within the past few years, roller skates have been produced where the wheels are arranged in tandem, but not disposed in a common plane. Typically, the wheels of these skates are arranged in alternately angled directions. For instance, one front wheel and one rear wheel are angled to the left and the other wheels are angled right. This arrangement is sometimes called a v-line skate.

When a skater with v-line skates leans the skates over to turn, those wheels angled in the direction of the turn become closer to horizontal with the skating surface than would like wheels in a standard inline skate. Those wheels angled opposite the direction of turn remain more upright than like wheels in a standard inline skate. This action greatly improves turning and maneuverability.

In the sport of inline hockey, there is a great desire to improve the maneuverability and to make the skate perform more like an ice hockey skate. The V-line or angled wheels do exactly that. They improve turning and make the skate feel more like a person is on ice.

The V-line type frames that are currently being used work well, but they are lacking in many respects over other skates. Conventional v-line skates support the wheel axles from only one side. Furthermore, each of the wheels is supported independently of the others. Both of these issues result in a heavy skate that is weak and lacking in stiffness.

Stiffness is important to skaters because a stiffer skate greatly improves acceleration and speed by transferring more energy to the skating surface. Conventional v-line skates lose stiffness by supporting the axle on only one side and by supporting each axle independently.

Conventional v-line skates are also structurally weak because the axles are supported from only one side. This causes the skate to be weaker and more prone to breaking. In order to compensate for this weakness, thicker material is used for the skate axle. The thicker material results in a heavier skate.

Skaters often lift their skates hundreds or even thousands of times a day. A heavy skate may cause the skater to become fatigued. Lighter skates would cause less fatigue. Additionally, lighter skates enable the skater to accelerate faster.

Many conventional v-line skates also require special wheels. As wheels tend to wear out, it would be more convenient for a skate to use standardly available wheels.

SUMMARY OF THE INVENTION

According to principles of the present invention, a roller skate has a base, a plurality of tandem frames, a like plurality of axles, and a like plurality of wheels. Each frame is affixed to the base and has bilateral, spaced apart, opposing side walls that define a wheel well. Adjacent side walls of the frames are interconnected to form a unitary opposing structure. The side walls of one of the frames are angularly related to the side walls of at least one of the other frames. Each axle is carried in a wheel well by the side walls of one of the frames. Each wheel is disposed within one of the wheel wells and mounted for rotation on the axle in the wheel well.

According to further principles of the present invention, the roller skate may further include an article of footwear, such as a shoe or a boot, to which the base is either affixed or integral. Additionally, at least one brace may interconnect the opposing walls of at least one frame.

DETAILED DESCRIPTION OF THE INVENTION

Figure 1:
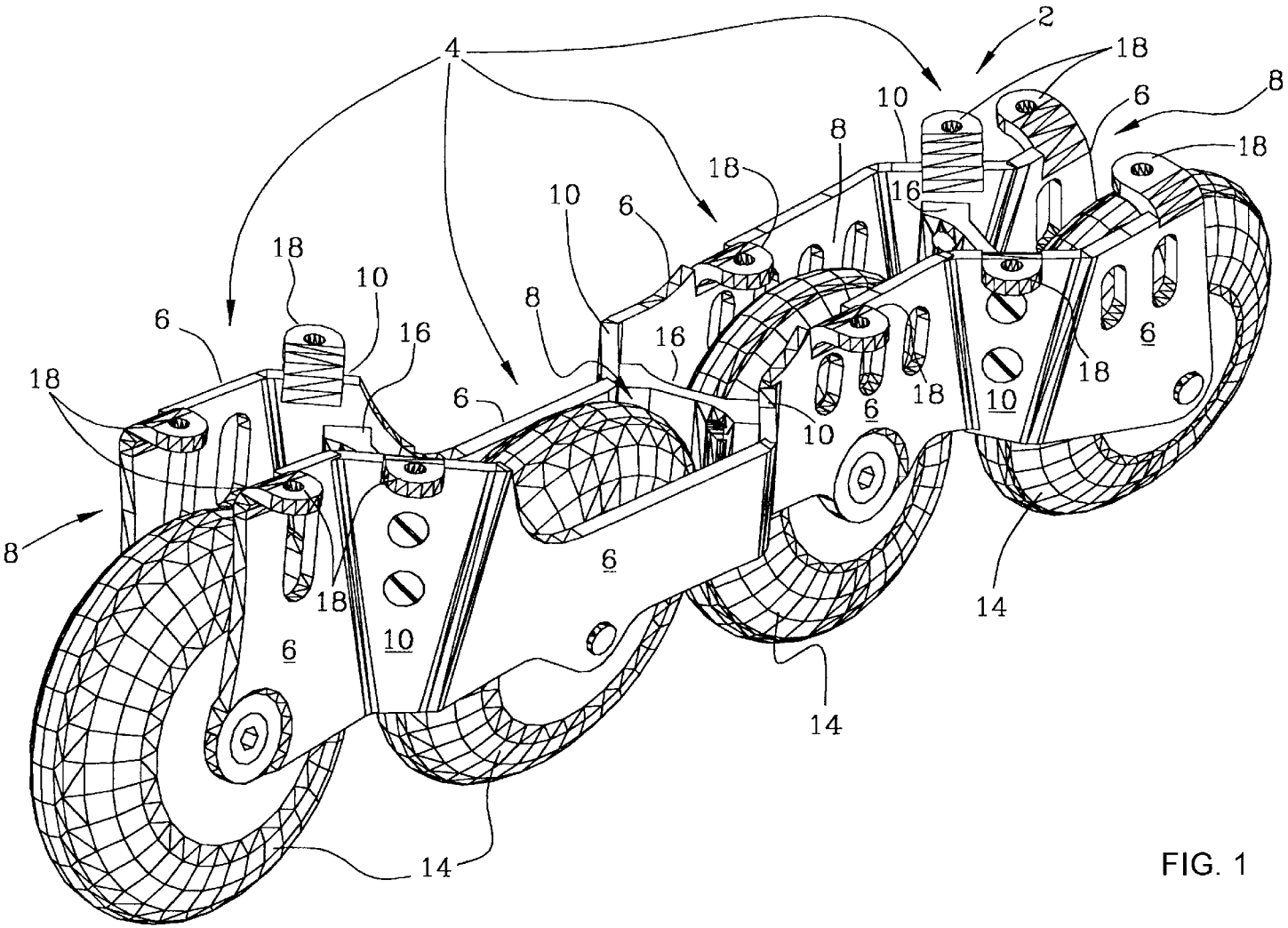
FIG. 1 is an orthogonal view of one embodiment of a skate undercarriage of the present invention.
Figure 2:
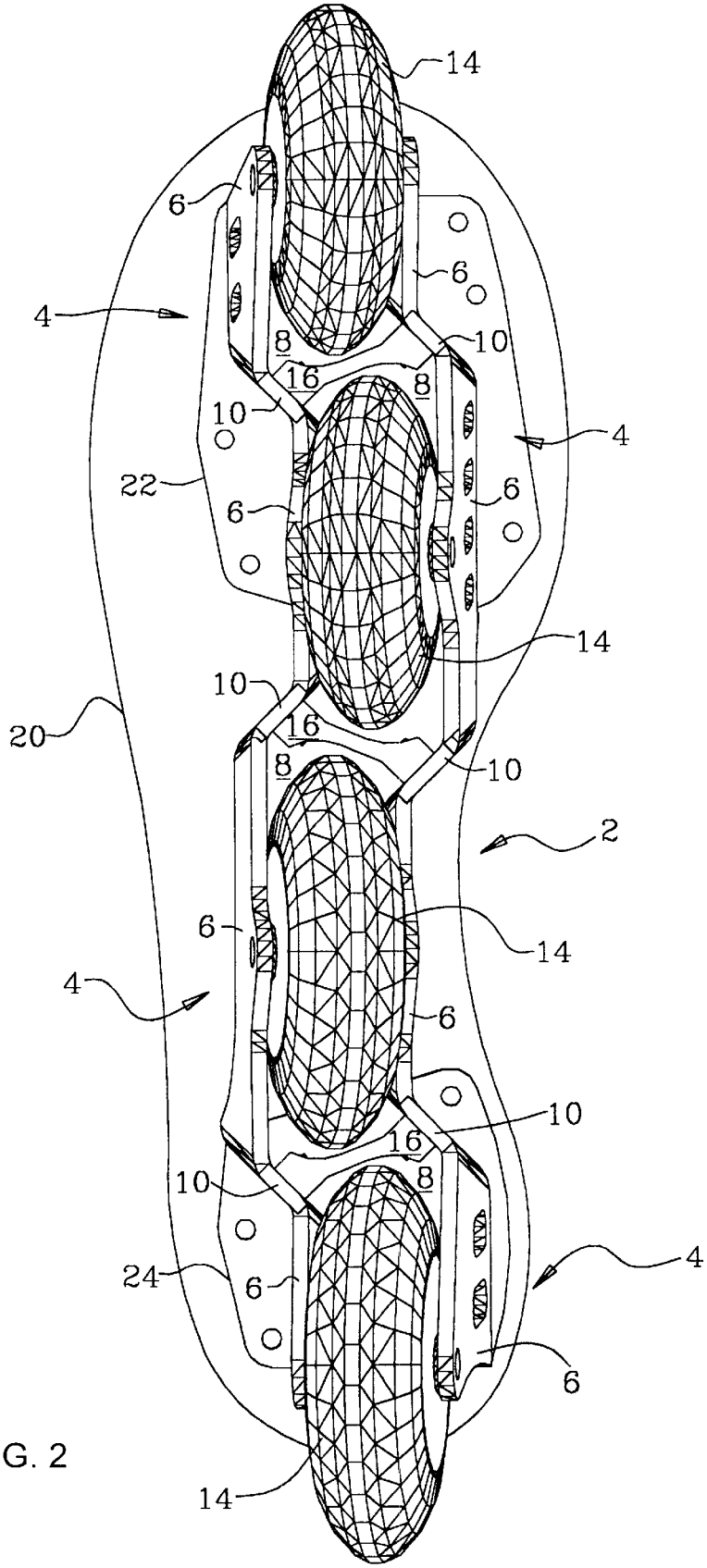
FIG. 2 is an exploded orthogonal view of the frames of one of the undercarriage of FIG. 1.
Figure 3:
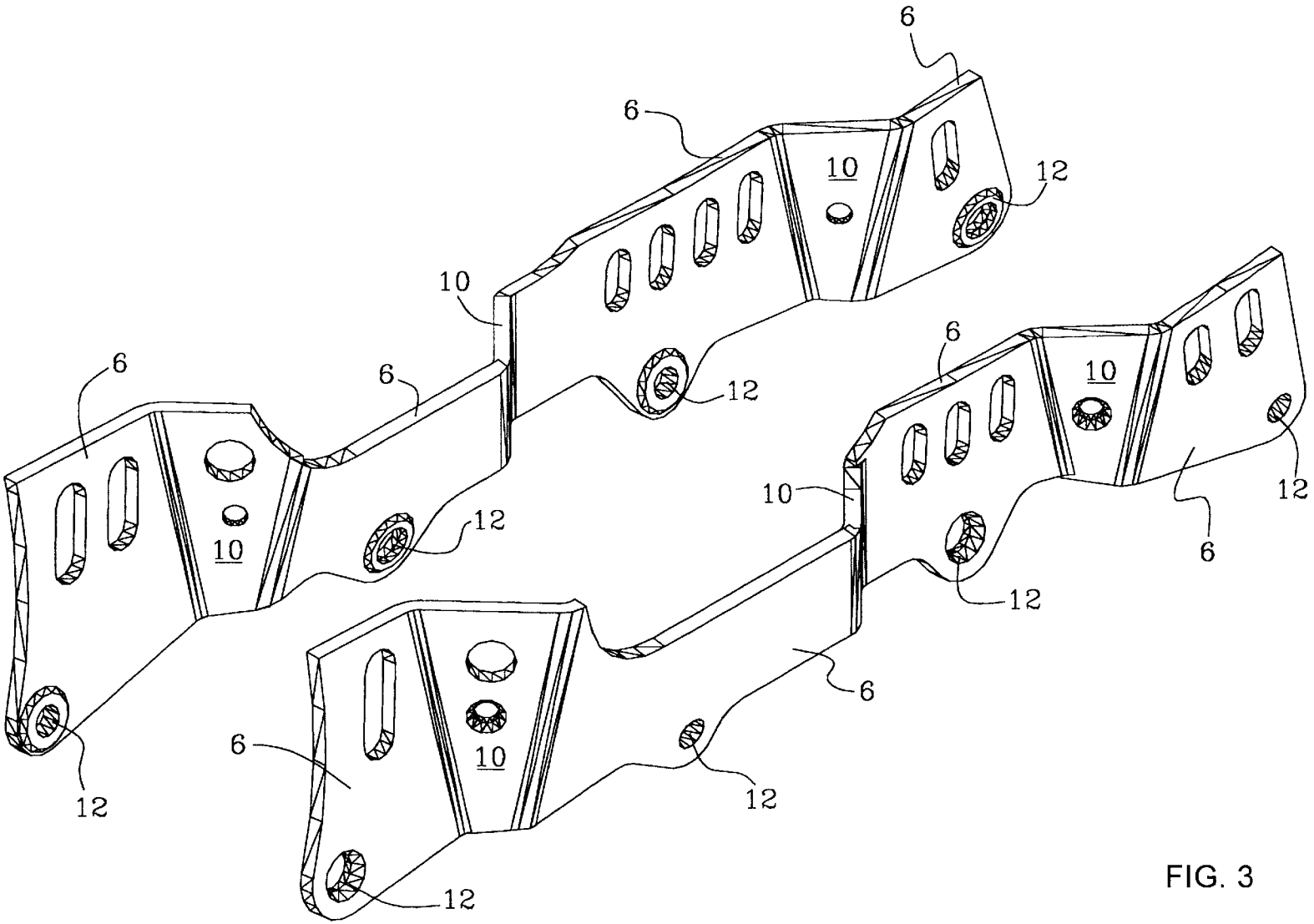
FIG. 3 is a bottom elevation of the present invention undercarriage for a skate, showing an alternate embodiment for attaching the undercarriage.

Referring to FIGS. 1–3, an undercarriage 2 is shown for skates. Undercarriage 2 includes a plurality of frames 4 aligned In tandem and disposed about a longitudinal axis 5. Tandem frames 4 are aligned one behind the other, but partially offset. Each frame 4 is constructed from any suitable material, for example, a lightweight, rigid metal. Although the figures illustrate four frames 4 for undercarriage 2, any number of frames 4 may be included in undercarriage 2 based on preference or necessity.

Each frame 4 includes bilateral, spaced apart, opposing side walls 6 defining a wheel well 8. Wheel wells 8 are either evenly spaced or unevenly spaced apart.

As best seen in FIG. 1, side walls 6 of at least one frame 4 are angularly related to side walls 6 of at least another frame 4. The angular relationship is responsible for the offset in alignment of frames 4. The figures illustrate side walls 6 of the frames 4 being alternately angularly related. Side walls 6 of the first and third frames 4 are parallel and angularly related to the side walls 6 of the second and forth frames 4. Included within the scope of the present invention are other arrangements of angularly related side walls 6.

Side walls 6 may be angularly related to each other at any angle greater than zero degrees. However, the arrangement of the present invention is particularly useful from about eleven degrees up to about twenty degrees. Additionally, the angle is most useful if divided so that each side wall 6 is angled an equal amount from perpendicular to a skating surface. For example, if side walls 6 are angled at fifteen degrees from other side walls 6, each set of side walls 6 is angled seven and one half degrees from perpendicular to the skating surface.

Adjacent side walls 6 are interconnected by linkages 10. In the illustrated embodiment, linkages 10 are plates. Other embodiments of linkages 10 are contemplated by the present invention. Linkages 10 significantly stiffen and strengthen undercarriage 2. As a result of the strength and stiffness of undercarriage 2, material may be removed from side walls 6 and linkages 10, creating a much lighter undercarriage 2 than would otherwise be possible.

As best seen in FIG. 3, an axle support 12 is formed in each side wall 6 of each frame 4. Axle supports 12 support each side of axles (not shown) for wheels 14. Supporting the wheel axles on each side further helps to create a much stiffer undercarriage 2.

Wheels 14 are disposed in wheel wells 8. Wheels 14 are arranged to roll in a uniform direction.

Braces 16 optionally interconnect opposing side walls 6. In the illustrated embodiment, braces 16 interconnect opposing side walls 6 through linkages 10. Alternatively, braces 16 interconnect opposing side walls 6 directly.

Undercarriage 2 is mounted to a base such as the sole of an article of footwear 20 or mounting plates. Illustrated in FIG. 2 is one embodiment for mounting undercarriage 2 to a base. Toe plate 22 and heel plate 24 are affixed to undercarriage 2 and also to footwear 20.

Illustrated in FIG. 1 is an alternate embodiment for mounting undercarriage 2 to a base. Mounting tabs 18 enable undercarriage 2 to be mounted to the sole of an article of footwear, such as a rigid skating boot.

The foregoing description is only illustrative of the invention. Various alternatives and modifications can be devised by those skilled in the art without departing from the invention. Accordingly, the present invention embraces all such alternatives, modifications, and variances that fall within the scope of the appended claims.

What is claimed is:

1. An undercarriage for a roller skate, the undercarriage comprising a plurality of tandem frames disposed about a longitudinal axis, each frame having bilateral, spaced apart, opposing side walls defining a wheel well, wherein adjacent side walls are interconnected, wherein the side walls of a first frame are angularly related to the side walls of at least a second frame, wherein each side wall of each frame includes an axle support, and wherein at least the side walls of the first frame are nonparallel to at least side walls of the second frame in a projection of at least the first and second frames on a plane perpendicular to the longitudinal axis.

2. The undercarriage of claim 1 wherein the wheel wells are equally spaced.

3. The undercarriage of claim 1 wherein the wheel wells are unequally spaced.

4. The undercarriage of claim 1 further including a like plurality of axles, each axle carried by the axle supports of the side walls of one of the frames.

5. The undercarriage of claim 4 further including a like plurality of wheels, each wheel disposed in one of the wheel wells and mounted for rotation on the axle carried by the axle supports of the side walls of the frame defining the wheel well.

6. The undercarriage of claim 1 further including mounting tabs affixed to at least one of the side walls for mounting the undercarriage to the sole of an article of footwear.

7. The undercarriage of claim 1 further including at least one mounting plate configured for mounting to the sole of an article of footwear and wherein at least one of the side walls is mounted to the at least one mounting plate.

8. The undercarriage of claim 1 further including at least one brace interconnecting the opposing walls of at least one frame.

9. The undercarriage of claim 1 wherein the side walls of the first frame are angularly related to the side walls of the at least second frame at an angle of between about eleven and about twenty degrees.

10. A roller skate comprising:

(a) a base;

(b) a plurality of tandem frames disposed about a longitudinal axis and affixed to the base, each frame having bilateral, spaced apart, opposing side walls defining a wheel well, wherein adjacent side walls are interconnected, wherein the side walls of a first frame are angularly related to the side walls of at least a second frame, and wherein at least the side walls of the first frame are nonparallel to at least side walls of the second frame in a projection of at least the first and second frames on a plane perpendicular to the longitudinal axis;

(c) a like plurality of axle, each axle carried by the side walls of one of the frames; and, (d) a like plurality of wheels, each wheel disposed in one of the wheel wells and mounted for rotation on the axle carried by the axle supports of the side walls of the frame defining the wheel well.

11. The roller skate of claim 10 wherein the wheel wells are equally spaced.

12. The roller skate of claim 10 wherein the wheel wells are unequally spaced.

13. The roller skate of claim 10 further including an article of footwear and wherein the base is affixed to the article footwear.

14. The roller skate of claim 10 further including an article of footwear and wherein the base is integral to the article of footwear.

15. The roller skate of claim 10 further including at least one brace interconnecting the opposing walls of at least one frame.

16. The roller skate of claim 10 wherein the side walls of the first frame are angularly related to the side walls of the at least second frame at an angle of between about eleven and about twenty degrees.

17. A roller skate comprising:

(a) a base:

(b) a plurality of tandem frames disposed about a longitudinal axis and affixed to the base, each frame having bilateral, spaced apart, opposing side walls defining a wheel well, wherein adjacent side walls are interconnected, wherein the side walls of a first frame are non-parallel to the side walls of at least a second frame;

(c) a like plurality of axles, each axle carried by the side walls of one of the frames, wherein at least the axle carried by at least the first frame is nonparallel to at least the axle carried by the second frame in a projection of at least the axles carried by the first and second frames on a plane perpendicular to the longitudinal axis; and, (d) a like plurality of wheels, each wheel disposed in one of the wheel wells and mounted for rotation on the axle carried by the axle supports of the side walls of the frame defining the wheel well.

18. The roller skate of claim 17 further including at least one brace interconnecting the opposing walls of at least one frame.

19. The roller skate of claim 17 wherein the side walls of the first frame are angularly related to the side walls of the at least second frame at an angle of between about eleven and about twenty degrees.

* * * * *

UNITED STATES PATENT AND TRADEMARK OFFICE

CERTIFICATE OF CORRECTION

PATENT NO. : 6,398,230 B1
DATED : June 4, 2002
INVENTOR(S) : Robert Rudolph

It is certified that error appears in the above-identified patent and that said Letters Patent is hereby corrected as shown below:

Drawings,
Figures 1-2, should appear as follows:

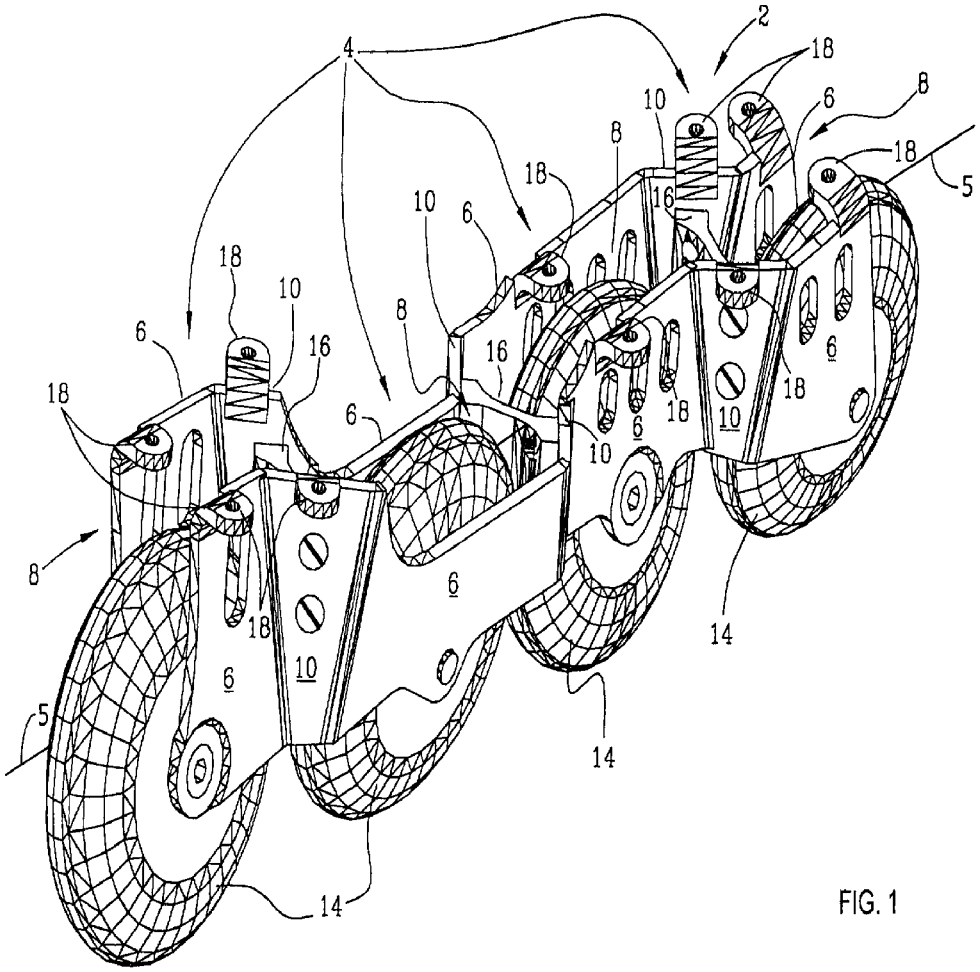

FIG. 1

UNITED STATES PATENT AND TRADEMARK OFFICE

CERTIFICATE OF CORRECTION

PATENT NO. : 6,398,230 B1
DATED : June 4, 2002
INVENTOR(S) : Robert Rudolph

It is certified that error appears in the above-identified patent and that said Letters Patent is hereby corrected as shown below:

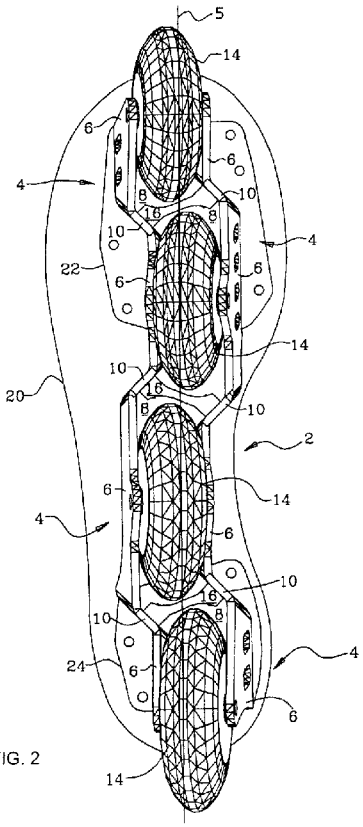

FIG. 2

Signed and Sealed this

First Day of October, 2002

*Attest:*

*Attesting Officer*

JAMES E. ROGAN
*Director of the United States Patent and Trademark Office*